US007208721B2

(12) United States Patent
Valentin et al.

(10) Patent No.: US 7,208,721 B2
(45) Date of Patent: Apr. 24, 2007

(54) CONTROLLER FOR MATERIAL DISPENSING NOZZLE CONTROL SIGNAL AND METHODS

(75) Inventors: Rico R. Valentin, Gallatin, TN (US); Scott J. Hudanish, Hendersonville, TN (US); Dieter B. Heerdt, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 147 days.

(21) Appl. No.: 10/994,801

(22) Filed: Nov. 22, 2004

(65) Prior Publication Data

US 2006/0108513 A1 May 25, 2006

(51) Int. Cl.
*G06M 7/00* (2006.01)
*B05C 11/00* (2006.01)

(52) U.S. Cl. ..... 250/221; 118/672

(58) Field of Classification Search ..... 250/221, 250/222.1; 427/8, 421; 118/672, 682
See application file for complete search history.

(56) References Cited

U.S. PATENT DOCUMENTS 3,667,846 A 6/1972 Nater et al.
4,044,250 A 8/1977 Fetzer
4,215,939 A 8/1980 Miller
4,458,152 A 7/1984 Bonora
4,530,862 A * 7/1985 Kerzel ..... 427/445
4,704,603 A 11/1987 Edwards et al.
4,831,258 A 5/1989 Paulk et al.
5,220,169 A 6/1993 Ninomiya et al.
5,319,202 A 6/1994 Pompei
5,438,233 A 8/1995 Boland et al.
5,683,752 A * 11/1997 Popp et al. ..... 427/8
5,717,485 A 2/1998 Ito et al.
5,839,829 A 11/1998 Litvin et al.
6,037,009 A * 3/2000 Clare et al. ..... 427/207.1
6,122,420 A 9/2000 Satoh
6,196,714 B1 3/2001 Bellifemine
6,299,931 B1 * 10/2001 Leary et al. ..... 427/8

(Continued)

FOREIGN PATENT DOCUMENTS

DE 4304343 8/1994

(Continued)

OTHER PUBLICATIONS

ITW Dynatec, "DY 2008 Pattern Controller" product specification. 2 pages.

*Primary Examiner*—Stephone B. Allen
(74) *Attorney, Agent, or Firm*—Donald J. Breh; Mark W. Croll; Lisa M. Soltis

(57) ABSTRACT

A material dispensing system for dispensing material onto a moving substrate (110), including a material dispensing nozzle (102), a material dispensing control signal controller (130) coupled to the material dispensing nozzle, a material dispensing control signal generator (120) coupled to the material dispenser control signal controller, the material dispensing control signal generator sending a material dispensing control signal to the material dispensing control signal controller, wherein the material dispensing control signal controller controls the material dispensing control signal from the material dispensing control signal generator based on the substrate speed input signal, and the material dispensing control signal controller sends the controlled material dispensing control signal to the material dispensing nozzle.

15 Claims, 3 Drawing Sheets

U.S. PATENT DOCUMENTS

| | | | | |
|---|---|---|---|---|
| 6,379,464 | B1 * | 4/2002 | Martel | 118/672 |
| 6,517,891 | B1 * | 2/2003 | Estelle et al. | 427/8 |
| 6,630,028 | B2 * | 10/2003 | Briese et al. | 118/683 |
| 6,770,142 | B2 * | 8/2004 | Estelle | 118/682 |
| 6,986,441 | B2 * | 1/2006 | Scordato et al. | 222/63 |
| 2005/0241576 | A1 * | 11/2005 | Gaon et al. | 118/665 |

FOREIGN PATENT DOCUMENTS

| | | |
|---|---|---|
| DE | 19750862 | 6/1999 |
| EP | 0373332 | 6/1990 |
| EP | 0852333 | 7/1998 |
| NL | 9401796 | 6/1996 |
| WO | 9634273 | 10/1996 |

* cited by examiner

FIG.3

| CHANNEL | 1 | 2 | 3 | 4 | |
|---|---|---|---|---|---|
| STITCH ON AT | 27 | 23 | 22 | 32 | FT/MIN |
| STITCH OFF AT | 34 | 33 | 24 | 22 | FT/MIN |
| STITCH BEAD | 100 | 120 | 99 | 89 | MSEC. |
| STITCH GAP | 50 | 80 | 100 | 120 | MSEC. |
| ACTIVE | YES | YES | YES | NO | |

CONTROLLER FOR MATERIAL DISPENSING NOZZLE CONTROL SIGNAL AND METHODS

FIELD OF THE DISCLOSURE

The present disclosure relates generally to controlling material dispensing systems, and more particularly to controlling material dispensing nozzle control signals, for example, controlling the dispensing of hot melt adhesives from valve controlled nozzles onto moving substrates, material dispensing signal controllers, and methods.

BACKGROUND OF THE DISCLOSURE

Pattern controllers that generate hot melt adhesive dispensing nozzle control signals are known generally. The ITW Dynatec DY 2008 pattern controller, for example, is a multi-channel hot melt adhesive nozzle pattern controller that generates 16 different adhesive dispensing patterns per channel. Particularly, the DY 2008 pattern controller generates various adhesive dispensing nozzle control signals that actuate valves that control adhesive dispensing nozzles. The DY 2008 pattern controller is also capable of controlling the adhesive dispensing nozzle control signals in a manner that causes the nozzles to dispense reduced adhesive volumes when the substrate speed is below a minimum speed. The reduced adhesive volumes are produced by controlling the nozzles to dispense adhesive dots, also referred to as a stitch pattern, with an intermittent control signal.

The objects, aspects, features and advantages of the present disclosure will become more fully apparent upon careful consideration of the following Detailed Description thereof and the accompanying Drawings, which may be disproportionate for ease of understanding, wherein like structure and steps are referenced generally by corresponding numerals and indicators.

BRIEF DESCRIPTION OF THE DRAWINGS

FIG. 3 illustrates exemplary parameters for a multi-channel material dispenser control signal controller.

DETAILED DESCRIPTION

Figure 1:
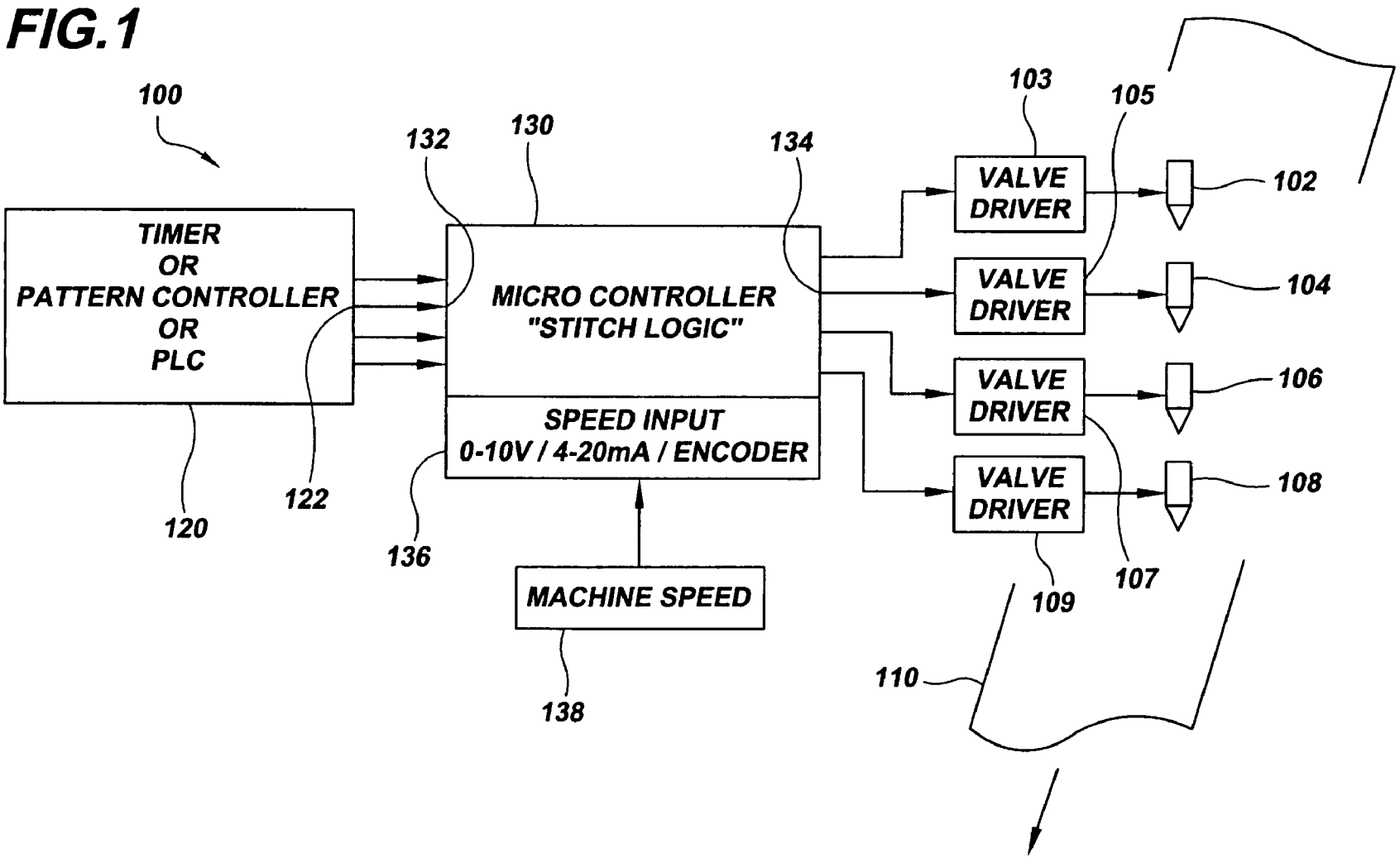
FIG. 1 is an exemplary material dispensing system including an apparatus for controlling a material dispenser control signal generated by another source.

FIG. 1 illustrates an exemplary material dispensing system 100, which is suitable for dispensing material onto a moving substrate 110. The system 100 comprises generally one or more material dispensing nozzles 102, 104, 106, 108 having corresponding valve drivers 103, 105, 107 and 109, respectively. The valve drivers are illustrated as discrete components in the exemplary embodiment, though more generally the nozzle and corresponding valve drivers may constitute an integrated nozzle device. Alternatively, the one or more valve drivers may be integrated with a material dispensing control signal controller discussed further below. The particular nozzle type is dependent generally on the type of material dispensed therefrom. In one embodiment, the one or more nozzles dispense glue, for example, a cold or hot melt adhesive, onto an underlying substrate 110, for example, packaging material or some other substrate. However, the disclosure is not limited to any particular nozzle type or material dispensing application. In embodiments where more than one nozzle is employed, the multiple nozzles are typically arranged in an array aligned non-parallel with the substrate direction so that the material is dispensed across the substrate.

Figure 2:
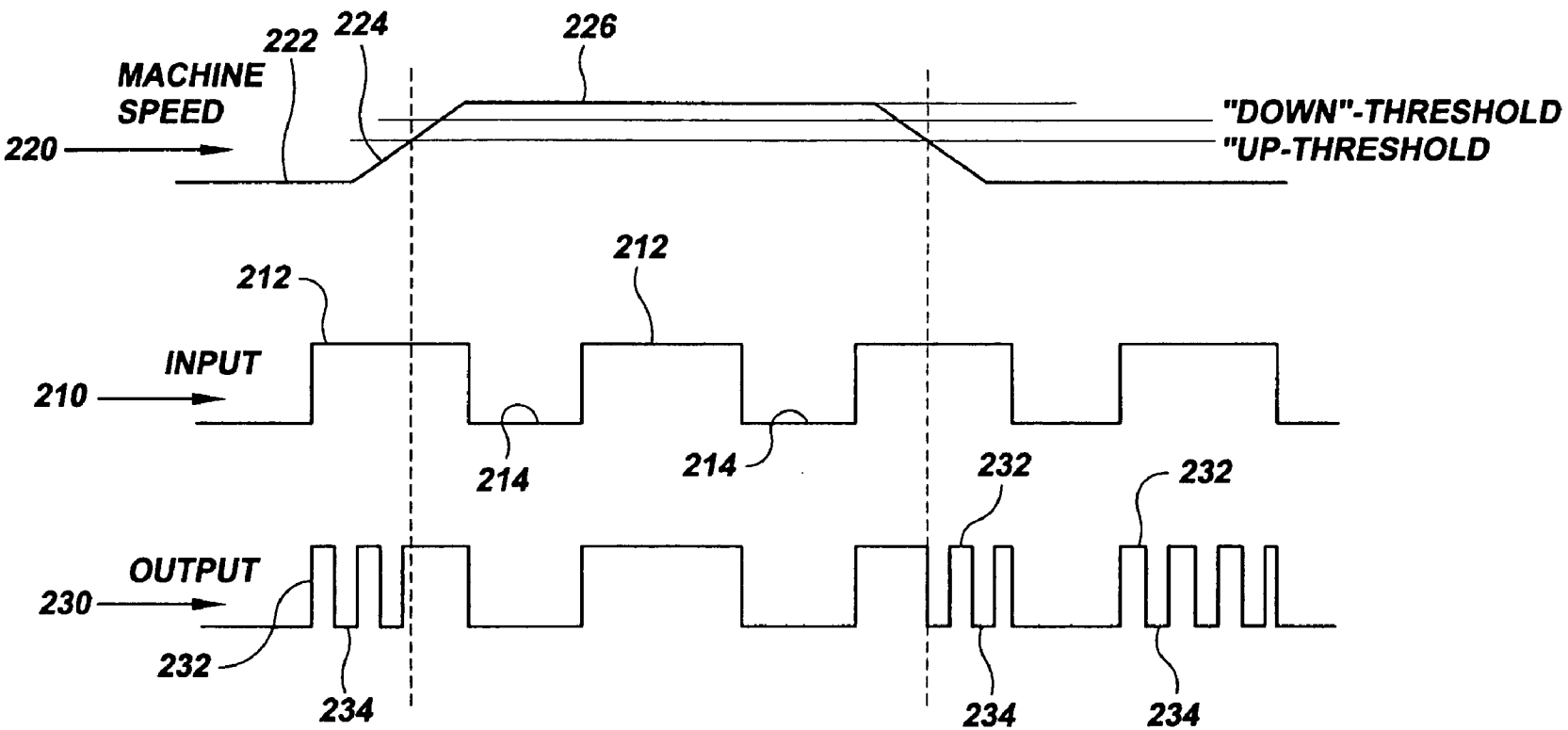
FIG. 2 illustrates exemplary nozzles control input and output signals relative to a machine speed signal.

In FIG. 1, the exemplary system 100 comprises a material dispensing control signal generator 120 for generating a material dispensing control signal for controlling the one or more nozzles. The control signal generator 120 produces a control signal for each of the one or more nozzles. Generally, the control signal generator independently generates a separate control signal for each nozzle, though in some embodiments or applications multiple nozzles may all receive the same control signal. FIG. 2 illustrates an exemplary nozzle control signal 210 for controlling a corresponding nozzle. The exemplary control signal is a relatively low voltage signal that operates a corresponding valve driver, which may amplify the signal for controlling the valve, for example, via an actuating solenoid. The exemplary signal 210 is an intermittent signal having a series of alternating ON intervals 212 and OFF intervals 214. The control signal 210 is exemplary and may take other forms, for example, the control signal may be a continuous ON signal or it may have an aperiodic character. The present disclosure is not limited to any particular material dispenser control signal form.

In FIG. 1, the exemplary system 100 also comprises a material dispensing control signal controller 130 coupled to the material dispensing nozzle and to the material dispensing control signal generator 120. In the exemplary embodiment, the material dispensing control signal generator 120 generates and sends one or more material dispensing control signals, from outputs 122, to one or more corresponding nozzles via the material dispensing control signal controller 130. Generally, the material dispensing control signal controller 130 is capable of controlling the material dispensing control signal by modifying the control signal before communicating the control signal to the one or more corresponding nozzles, as discussed further below. The material dispensing control signal controller 130 is also capable of communicating the control signal from the signal generator 120 to a nozzle without modification, also discussed further below. The material dispensing control signal controller 130 thus includes one or more control signal inputs 132 for receiving a material dispenser control signal from a signal generating source, and one or more control signal outputs 134 for communicating modified or unmodified material dispenser control signals to one or more nozzles.

In FIG. 1, the material dispenser control signal controller comprises a substrate speed input 136 for receiving a substrate speed input signal indicative of a rate of movement of the substrate 110. The substrate speed input signal may be generated by an encoder 138, for example, an optical or rotary encoding device, that monitors the moving substrate 110, or some other encoding device that outputs a signal indicative of the substrate speed and changes therein. The substrate speed input signal may also be obtained from a conveyor controller or from some other source. More generally the speed signal may be indicative of the speed or rate of something other than a substrate or conveyor. FIG. 2 illustrates an exemplary machine speed signal 220 that begins from a relatively low speed value, for example, zero speed, then ramps up toward a comparatively steady state speed before ramping back down toward the relatively low speed.

Generally, the material dispenser control signal controller controls the material dispenser control signal based on the machine speed input signal, and the material dispenser control signal controller outputs the controlled material dispenser control signal to a corresponding nozzle or other device. In one embodiment, for example, the controller controls the material dispenser control signal when the machine speed input signal satisfies a condition. The material dispenser control signal controller outputs the controlled material dispenser control signal to the nozzle or other device when the condition is satisfied, and outputs the material dispenser control signal received at the material dispenser control signal input, without modification, when the condition is not satisfied.

In some applications, it is desirable to control the amount of material dispensed by or from the nozzle as the machine speed changes. Thus in one particular embodiment, for example, the material dispenser control signal controller controls the material dispenser control signal only when the machine speed input signal indicates that the machine speed is below a speed threshold. According to this example, the controlled material dispenser control signal is output at the material dispenser control signal output when the machine speed is below the threshold, and the material dispenser control signal received at the material dispenser control signal input is output at the material dispenser control signal output when the machine speed input signal is not below the threshold. Thus the controller may control a material dispenser control signal based on a machine speed input signal indicating that an increasing or decreasing machine speed is below a threshold. An exemplary embodiment is discussed below.

In one embodiment, the material dispenser control signal controller controls or modifies the control signal from the pattern controller by intermittently turning ON and OFF the control signal under specified conditions, for example, when a threshold machine speed is or is not attained. Such intermittent operation, referred to a "stitch" mode operation in material dispensing applications, may be used to decrease the amount or volume of material dispensed when the machine speed is relatively slow.

In FIG. 2, the machine speed signal 220 corresponds to the substrate speed or other machine speed monitored, for example, by the encoder 138 in FIG. 1. In FIG. 2, at 222, the machine speed is at an initial speed, for example, zero speed or some other nominal speed. At 224, the machine speed increases from the initial speed to a target or operating speed 226, which is a relatively constant steady-state speed in the exemplary embodiment. In other embodiments, however, the target or operating speed 226 may be a variable speed, for example, a speed maintained above some minimum or reference speed. FIG. 2 also illustrates the input material dispensing control signal 210, from a material dispenser control signal generator, in timed relation to the machine speed signal 220. The exemplary input control signal is intermittent with alternating ON and OFF intervals discussed above, though more generally the input signal 210 may have any form produced by the material dispenser control signal generator, for example, pattern controller 120 in FIG. 1.

In FIG. 2, when the machine speed 220 is below a first threshold speed, referenced as the UP threshold, the material dispenser control signal controller modifies the input signal 210. In the exemplary embodiment, the input signal 210 is modified during the ON intervals 212 such that the ON intervals of the input signal are made intermittent with corresponding ON and OFF intervals. FIG. 2 illustrates the modified control signal, referred to as an output signal at 230, which is output by the material dispenser control signal controller. In FIG. 1, for example, the controller 130 outputs the modified control signal to one or more of the exemplary nozzles 102, 104 . . . via a corresponding channel. In FIG. 2, at least some of the ON intervals of the input signal have alternating intermittent ON and OFF periods 232 and 234, respectively. In FIG. 2, when the machine speed reaches the threshold speed, UP threshold, the material dispenser control signal controller discontinues controlling the material dispensing signal, and the output signal 230 corresponds to the input signal 210.

In FIG. 2, when the machine speed decreases below a second threshold speed, referenced as the DOWN threshold, the material dispenser control signal controller again modifies the input signal. In the exemplary embodiment, at least some of the ON intervals of the input signal 210 are modified to produce an output signal 230 having an intermittent form with corresponding ON and OFF period intervals 232 and 234, respectively. In FIG. 2, the second (DOWN) threshold is greater than the first (UP) threshold, though in other embodiments the first and second thresholds could be equal or the first threshold could be greater than the second threshold.

In FIG. 2, when the machine speed is below the UP and DOWN threshold speed, the input signal is modified during the ON intervals such that the output signal is made intermittent with corresponding ON and OFF period times corresponding to the ON intervals of the input signal. In some embodiments, not illustrated in FIG. 2, the material dispenser control signal controller completely turns OFF the output signal when the machine speed is below a lower threshold, for example, when the machine speed is zero.

Generally, in FIG. 1, the control signal on each output channel of the pattern controller 120 is controlled independently by the material dispenser control signal controller 130 based on the machine speed input signal. In another embodiment, the material dispenser control signal controller 130 maybe operated in a mode that merely passes control signals from the pattern controller 130, or in a mode that controls or modifies the control signals as discussed above and further below.

FIG. 3 illustrates an exemplary control signal configuration table for a multi-channel material dispenser control signal controller, for example, adhesive control signal controller 130 in FIG. 1. In FIG. 3, the stitch ON threshold, corresponding to the UP threshold in FIG. 2, for each channel is expressed in feet/minute and is set or programmed independently. Similarly, the stitch OFF threshold, corresponding to the DOWN threshold in FIG. 2, for each channel is also set or programmed independently. In FIG. 3, the stitch bead for each channel, corresponding to the ON intervals 232 of the modified control output signal 230 in FIG. 2, is also set or programmed independently for each channel. Similarly, the stitch bead gap, corresponding to the OFF interval 234 of the modified control output signal in FIG. 2, is set or programmed independently. In FIG. 3, the stitch bead and stitch bead gaps are expressed in units of time (msec.), though in other embodiments they could be expressed in other units. The "active" status in FIG. 3 indicates whether the channel control of the control signal controller is OFF or ON.

While the foregoing written description of the disclosure enables one of ordinary skill to make and use what are considered presently to be the best modes thereof and evidences the rightful possession thereof, those of ordinary skill will understand and appreciate the existence of variations, combinations, and equivalents of the specific exemplary embodiments herein. The inventions are therefore to be limited not by the exemplary embodiments herein, but by all embodiments within the scope and spirit of the appended claims.

What is claimed is:

1. An apparatus for controlling a material dispenser control signal, the apparatus comprising:

a material dispenser control signal input for receiving a material dispenser control signal from another source, the material dispenser control signal for controlling a material dispenser nozzle;

a machine speed input for receiving a machine speed input signal;

a controller for controlling the material dispenser control signal based on the machine speed input signal satisfying a condition;

a controlled material dispenser control signal is output at the material dispenser control signal output when the condition is satisfied, and the material dispenser control signal received at the material dispenser control signal input is output at the material dispenser control signal output when the condition is not satisfied.

2. The apparatus of claim 1, the controller for controlling the material dispenser control signal based on the machine speed input signal indicating that increasing machine speed is below a first threshold, whereby the controlled material dispenser control signal is output at the material dispenser control signal output when the increasing machine speed is below the first threshold, and the material dispenser control signal received at the material dispenser control signal input is output at the material dispenser control signal output when the machine speed input signal is not below the threshold.

3. The apparatus of claim 1, the controller for controlling the material dispenser control signal based on the machine speed input signal indicating that decreasing machine speed is below a second threshold different than a first threshold, whereby the controlled material dispenser control signal is output at the material dispenser control signal output when the decreasing machine speed is below the second threshold, and the material dispenser control signal received at the material dispenser control signal input is output at the material dispenser control signal output when the machine speed input signal is not below the threshold.

4. The apparatus of claim 1, the controller for controlling the material dispenser control signal by intermittently turning OFF and ON the material dispenser control signal based on the machine speed input signal.

5. The apparatus of claim 1, the controller for controlling the material dispenser control signal by intermittently interrupting the material dispenser control signal when the condition is satisfied.

6. The apparatus of claim 1, the controller for intermittently interrupting the material dispenser control signal when the machine speed input signal indicates that the machine speed is below a speed threshold, whereby the intermittently interrupted material dispenser control signal is output at the material dispenser control signal output when the machine speed input signal indicates that the machine speed is below the speed threshold, and the material dispenser control signal received at the material dispenser control signal input is output at the material dispenser control signal output when the machine speed input signal indicates that the machine speed is above the speed threshold.

7. The apparatus of claim 1, the controller for intermittently interrupting the material dispenser control signal when the machine speed input signal indicates an increasing machine speed is below a first speed threshold, and the controller for intermittently interrupting the material dispenser control signal when the machine speed input signal indicates a decreasing machine speed is below a second speed threshold different than the first speed threshold.

8. A method in a controller for a nozzle valve, the method comprising:

receiving a control signal, from a control signal generator, at a control signal input of the controller;

receiving a signal indicative of a machine speed at a machine speed input of the controller;

modifying the control signal based on the machine speed signal;

outputting the modified control signal during machine speed changes, and outputting the received control signal when not outputting the modified control signal.

9. The method of claim 8, modifying the control signal when the machine speed signal indicates that the machine speed is below a threshold machine speed, outputting the modified control signal when the machine speed is below the threshold machine speed, and outputting the received control signal when the machine speed is above the threshold machine speed.

10. The method of claim 8, modifying the control signal when an increasing machine speed is below a first threshold, outputting the modified control signal when the increasing machine speed is below the first threshold, outputting the received control signal when the increasing machine speed is not below the first threshold.

11. The method of claim 10, modifying the control signal when a decreasing machine speed is below a second threshold different than the first threshold, outputting the modified control signal when the decreasing machine speed is below the second threshold, outputting the received control signal when the decreasing machine speed is not below the second threshold.

12. The method of claim 8, modifying the control signal by reducing an average ON time of the control signal during transient machine speed changes.

13. The method of claim 8, the control signal having intermittent ON and OFF intervals, modifying the control signal by intermittently turning ON and OFF the control signal during at least some of the intermittent ON intervals.

14. The method of claim 13, modifying the control signal when the machine speed is below a speed threshold, outputting the modified control signal when the machine speed is below the speed threshold, outputting the received control signal when the machine speed is not below the speed threshold.

15. An apparatus for controlling a material dispenser control signal, the apparatus comprising:

a material dispenser control signal input for receiving a material dispenser control signal from another source, the material dispenser control signal for controlling a material dispenser nozzle;

a machine speed input for receiving a machine speed input signal;

a controller for controlling the material dispenser control signal based on the machine speed input signal, the controller for controlling the material dispenser control signal by intermittently turning OFF and ON the material dispenser control signal based on the machine speed input signal;

a material dispenser control signal output for outputting the controlled material dispenser control signal.

* * * * *